US010513321B1

(12) United States Patent
Hegel

(10) Patent No.: US 10,513,321 B1
(45) Date of Patent: Dec. 24, 2019

(54) WATERCRAFT PROPULSION DEVICE

(71) Applicant: Jerry Hegel, Mundare (CA)

(72) Inventor: Jerry Hegel, Mundare (CA)

( * ) Notice: Subject to any disclaimer, the term of this patent is extended or adjusted under 35 U.S.C. 154(b) by 0 days.

(21) Appl. No.: 16/014,140

(22) Filed: Jun. 21, 2018

(51) Int. Cl.
*B63H 5/16* (2006.01)
*B63H 5/14* (2006.01)
*B63H 11/08* (2006.01)

(52) U.S. Cl.
CPC ..... *B63H 5/165* (2013.01); *B63H 5/14* (2013.01); *B63H 11/08* (2013.01)

(58) Field of Classification Search
CPC . B63H 5/14; B63H 5/165; B63H 5/16; B63H 5/00; B63H 11/00; B63H 11/08
USPC ..... 440/72, 38
See application file for complete search history.

(56) References Cited

U.S. PATENT DOCUMENTS

| | | | | |
|---|---|---|---|---|
| 3,358,635 | A * | 12/1967 | McRee | B63B 35/817 440/72 |
| 4,427,393 | A | 1/1984 | May | |
| 6,475,045 | B2 | 11/2002 | Schultz | |
| 6,554,660 | B2 * | 4/2003 | Irish | B63H 5/14 440/38 |
| 6,725,797 | B2 | 4/2004 | Hilleman | |
| 7,172,477 | B1 | 2/2007 | Rollins | |
| 7,229,331 | B2 | 6/2007 | Norman | |
| 8,491,268 | B2 | 7/2013 | Chamberlain | |
| 2012/0251322 | A1 | 10/2012 | McGee | |

* cited by examiner

*Primary Examiner* — Lars A Olson

(57) ABSTRACT

A watercraft propulsion device for protecting marine life includes a tube that is coupled to a hull of a marine vessel. The tube has a front end and a back end that are open. The front end is circumferentially larger than the back end so that the tube is tapered. An impeller assembly is positioned in the tube. The impeller assembly is operationally coupled to a drive shaft of the marine vessel. A power plant of the marine vessel is positioned to rotate the impeller assembly concurrently with the drive shaft to increase a pressure and a flow of water through the tube to generate thrust to propel the marine vessel. A grate is coupled to a front perimeter of the tube so that the grate covers the front end. The grate is configured to deter entry of a marine organism into the tube.

16 Claims, 6 Drawing Sheets

WATERCRAFT PROPULSION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to propulsion devices and more particularly pertains to a new propulsion device for protecting marine life.

BRIEF SUMMARY OF THE INVENTION

An embodiment of the disclosure meets the needs presented above by generally comprising a tube that is coupled to a hull of a marine vessel. The tube has a front end and a back end that are open. The front end is circumferentially larger than the back end so that the tube is tapered. An impeller assembly is positioned in the tube. The impeller assembly is operationally coupled to a drive shaft of the marine vessel. A power plant of the marine vessel is positioned to rotate the impeller assembly concurrently with the drive shaft to increase a pressure and a flow of water through the tube to generate thrust to propel the marine vessel. A grate is coupled to a front perimeter of the tube so that the grate covers the front end. The grate is configured to deter entry of a marine organism into the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
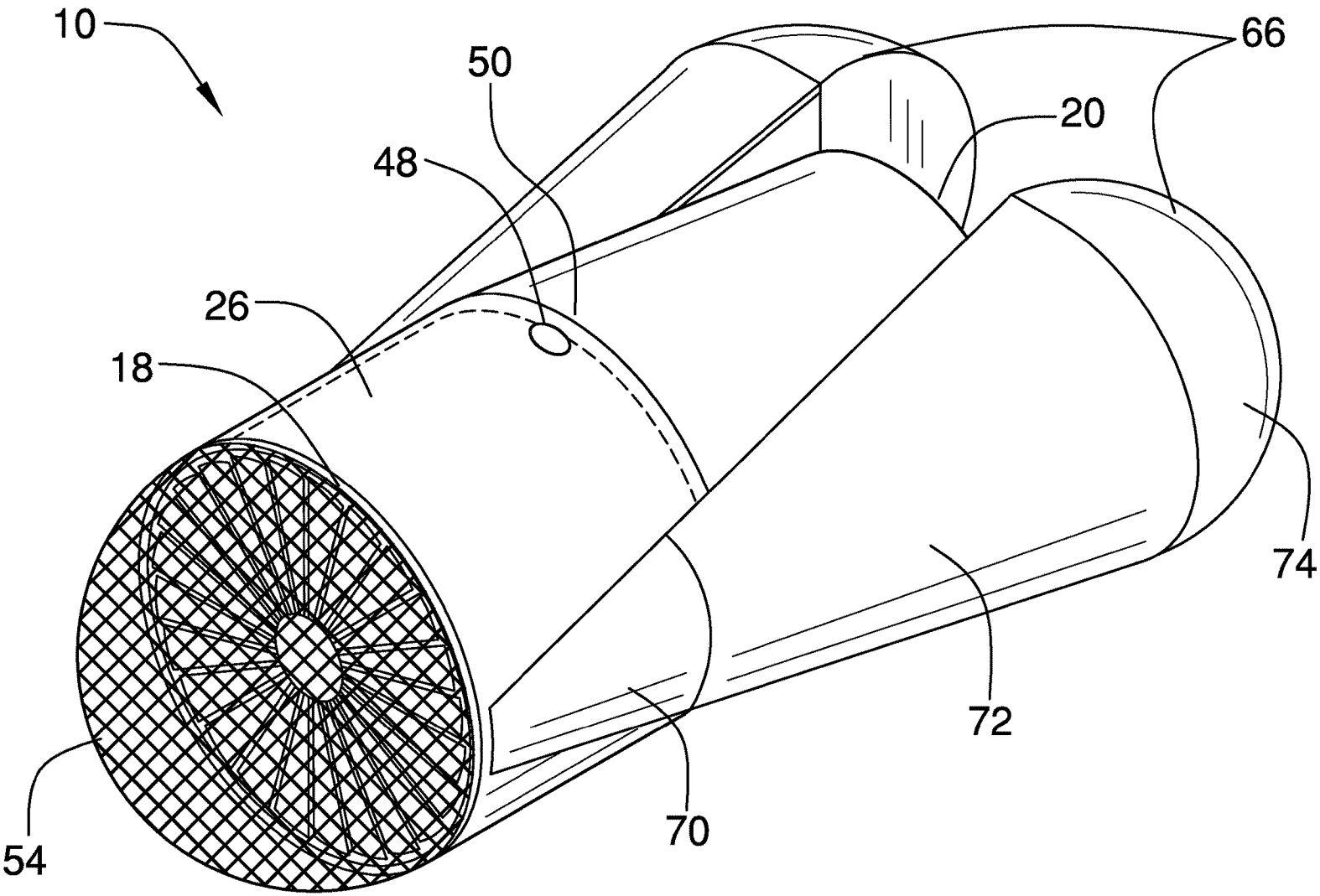
FIG. 1 is an isometric perspective view of a watercraft propulsion device according to an embodiment of the disclosure.

With reference now to the drawings, and in particular to FIGS. 1 through 6 thereof, a new propulsion device embodying the principles and concepts of an embodiment of the disclosure and generally designated by the reference numeral 10 will be described.

Figure 2:
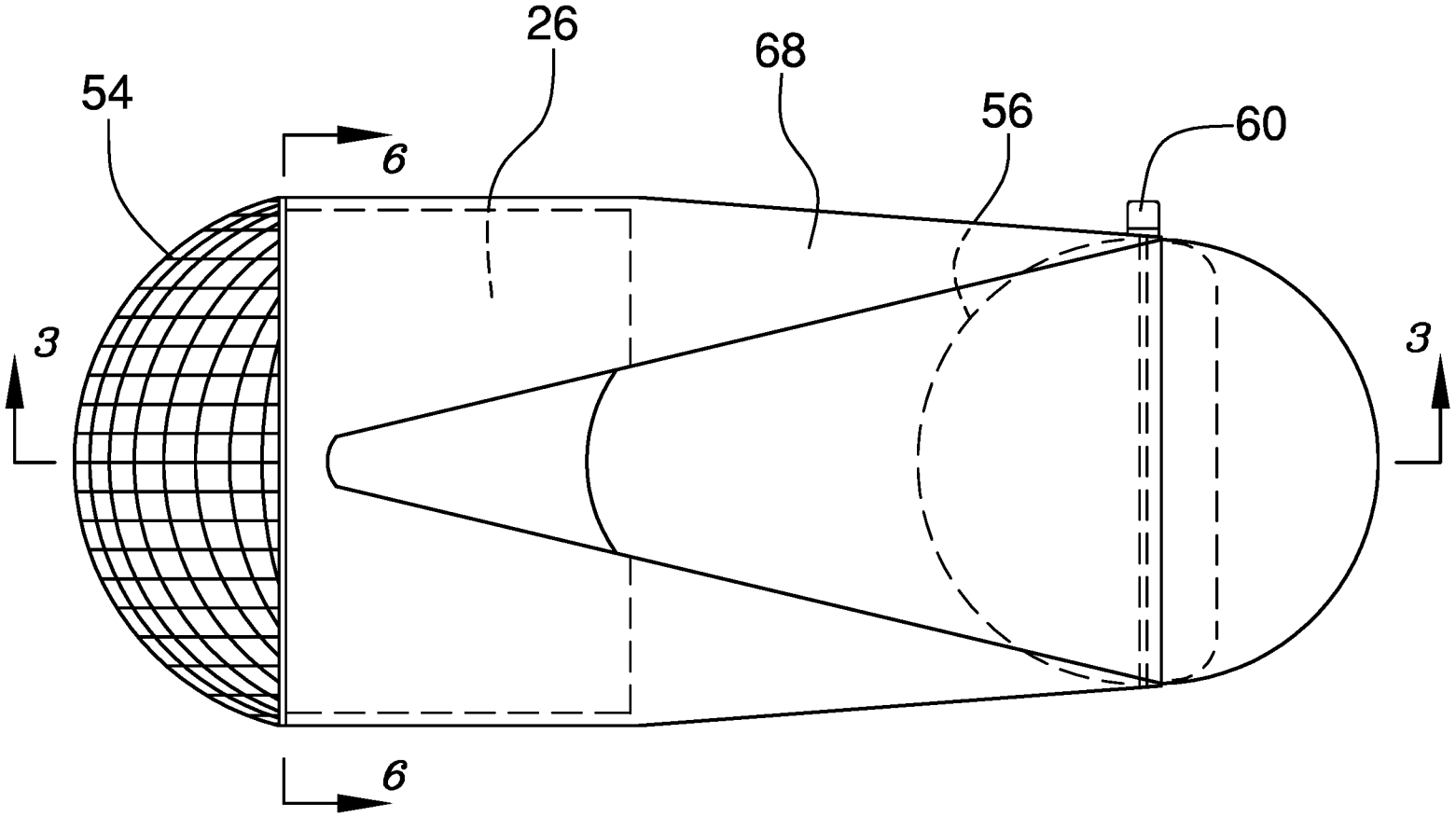
FIG. 2 is a side view of an embodiment of the disclosure.

As best illustrated in FIGS. 1 through 6, the watercraft propulsion device 10 generally comprises a tube 12 that is coupled to a hull 14 of a marine vessel 16. The tube 12 has a front end 18 and a back end 20 that are open. The front end 18 is circumferentially larger than the back end 20 so that the tube 12 is tapered, as shown in FIG. 2. The tube 12 has a front perimeter 22 and a back perimeter 24. The back perimeter 24 measures from sixty to ninety percent of the front perimeter 22. The back perimeter 24 measures eighty percent of the front perimeter 22.

Figure 4:
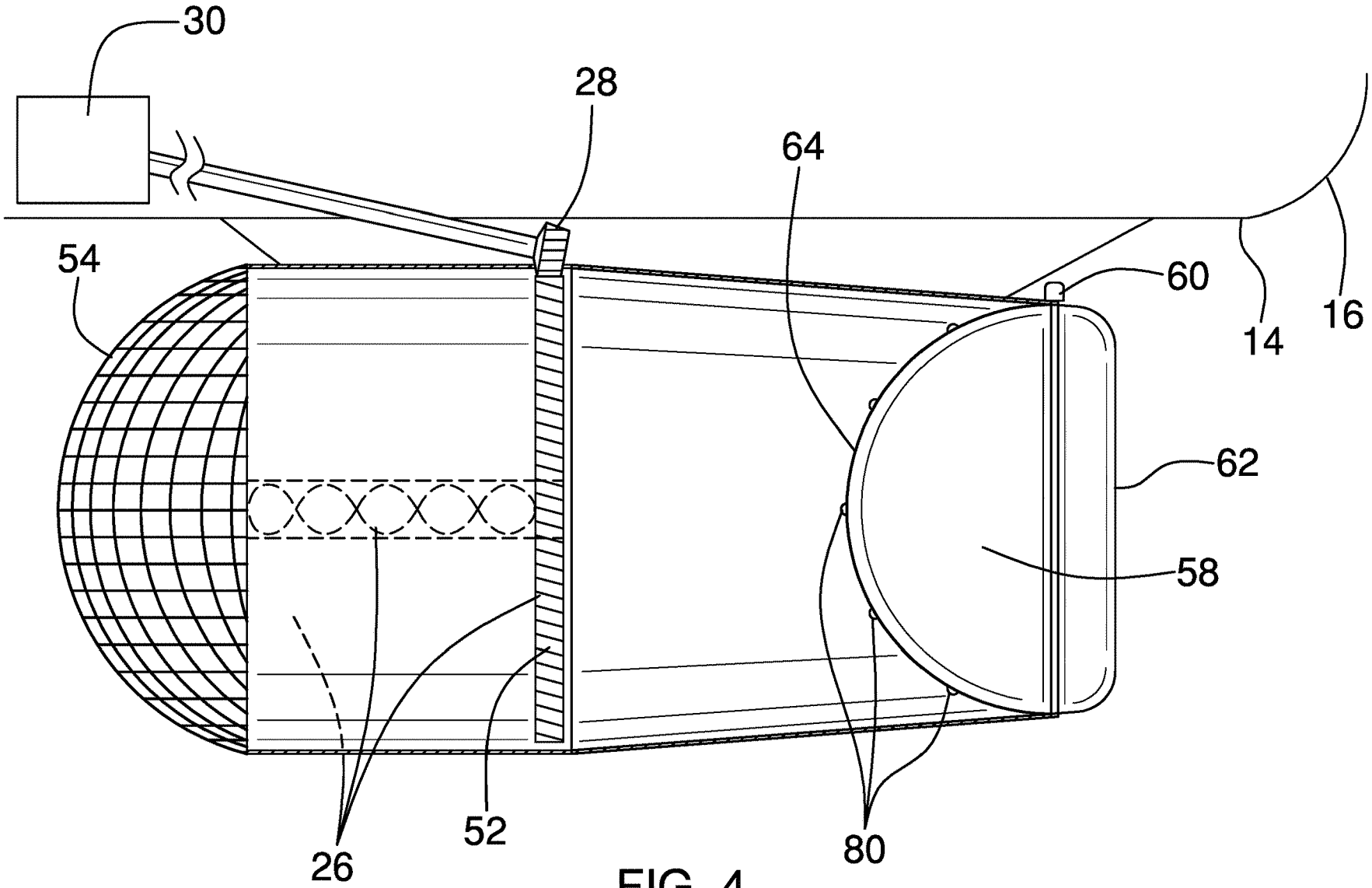
FIG. 4 is a side view of an embodiment of the disclosure.

An impeller assembly 26 is positioned in the tube 12. The impeller assembly 26 is operationally coupled to a drive shaft 28 of the marine vessel 16, as shown in FIG. 4. A power plant 30 of the marine vessel 16 is positioned to rotate the impeller assembly 26 concurrently with the drive shaft 28 to increase a pressure and a flow of water through the tube 12 to generate thrust to propel the marine vessel 16. The tapering of the tube 12 serves to enhance the thrust.

The impeller assembly 26 comprises an impeller 32, which in turn comprises an inner ring 34, an outer ring 36, and a plurality of vanes 38. Each vane 38 is coupled to and extends between the inner ring 34 and the outer ring 36. The plurality of vanes 38 comprises from eight to thirty-six vanes 38. The number of vanes 38, as well as the size and pitch of each vane 38 and the tapering of the tube 12, would be selected based on the size and function of the marine vessel 16.

Figure 6:
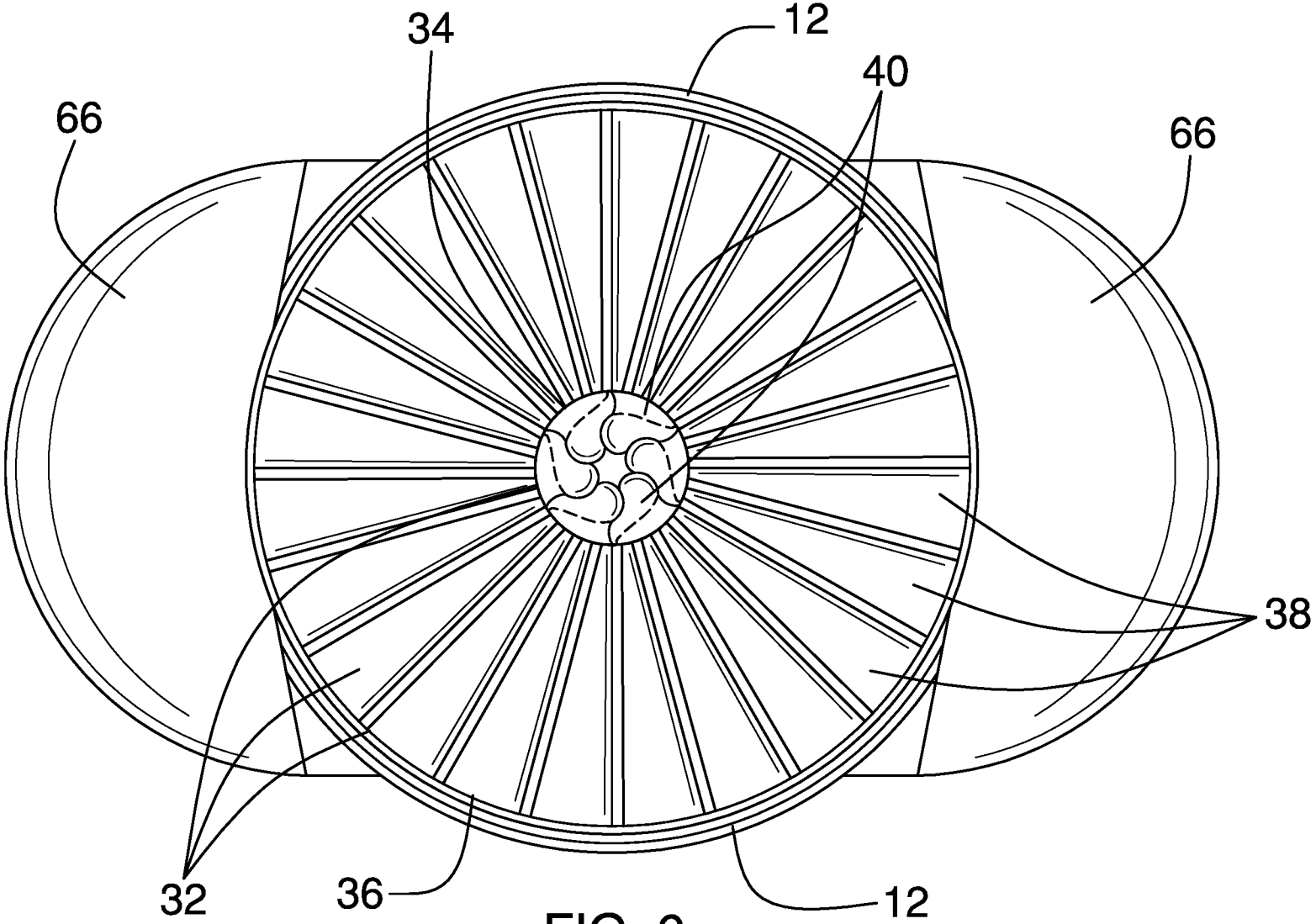
FIG. 6 is a front view of an embodiment of the disclosure.

A plurality of blades 40 is coupled to and positioned within the inner ring 34, as shown in FIG. 6. Each blade 40 extends spirally from a front edge 42 to a back edge 44 of the inner ring 34. The blades 40 are configured to increase the pressure and the flow of the water through the inner ring 34. The plurality of blades 40 comprises from three to nine blades 40.

A drive gear 46 is coupled to the impeller 32. An opening 48 positioned in a top 50 of the tube 12. The drive shaft 28 extends through the opening 48 into the tube 12 so that the drive shaft 28 is gearedly coupled to the drive gear 46. The power plant 30 of the marine vessel 16 is positioned to rotate the impeller assembly 26 concurrently with the drive shaft 28 to increase the pressure and the flow of the water through the tube 12 to propel the marine vessel 16.

The drive gear 46 comprises a bevel gear 52 that is coupled to an outer surface 78 of the outer ring 36. The present invention also anticipates the drive gear 46 being crown gear type. Water passing between the outer ring 36 and the tube 12 serves as a water bushing to facilitate rotation of the impeller assembly 26 within the tube 12.

A grate 54 is coupled to the front perimeter 22 of the tube 12 so that the grate 54 covers the front end 18, as shown in FIG. 1. The grate 54 is substantially hemispherically shaped or the like. The grate 54 is configured to deter entry of a marine organism into the tube 12, thereby helping to prevent contact of the marine organism with the impeller assembly 26.

A baffle 56 is coupled to and positioned in the tube 12 proximate to the back end 20. The baffle 56 is configured to selectively control the flow of the water through the back end 20 of the tube 12 to adjust a speed and a direction of the marine vessel 16.

The baffle 56 comprises a plate 58 and a baffle actuator 60. The plate 58 is semi-circularly shaped to define a straight edge 62 and a curved edge 64 of the plate 58. The plate 58 is coupled to and extend between the back perimeter 24 of the tube 12 so that the plate 58 is substantially perpendicular to the hull 14 and so that the straight edge 62 protrudes from the back end 20 of the tube 12. The baffle actuator 60 is coupled to the tube 12. The baffle actuator 60 is linear-type. The baffle actuator 60 is operationally coupled to the plate 58.

Figure 3:
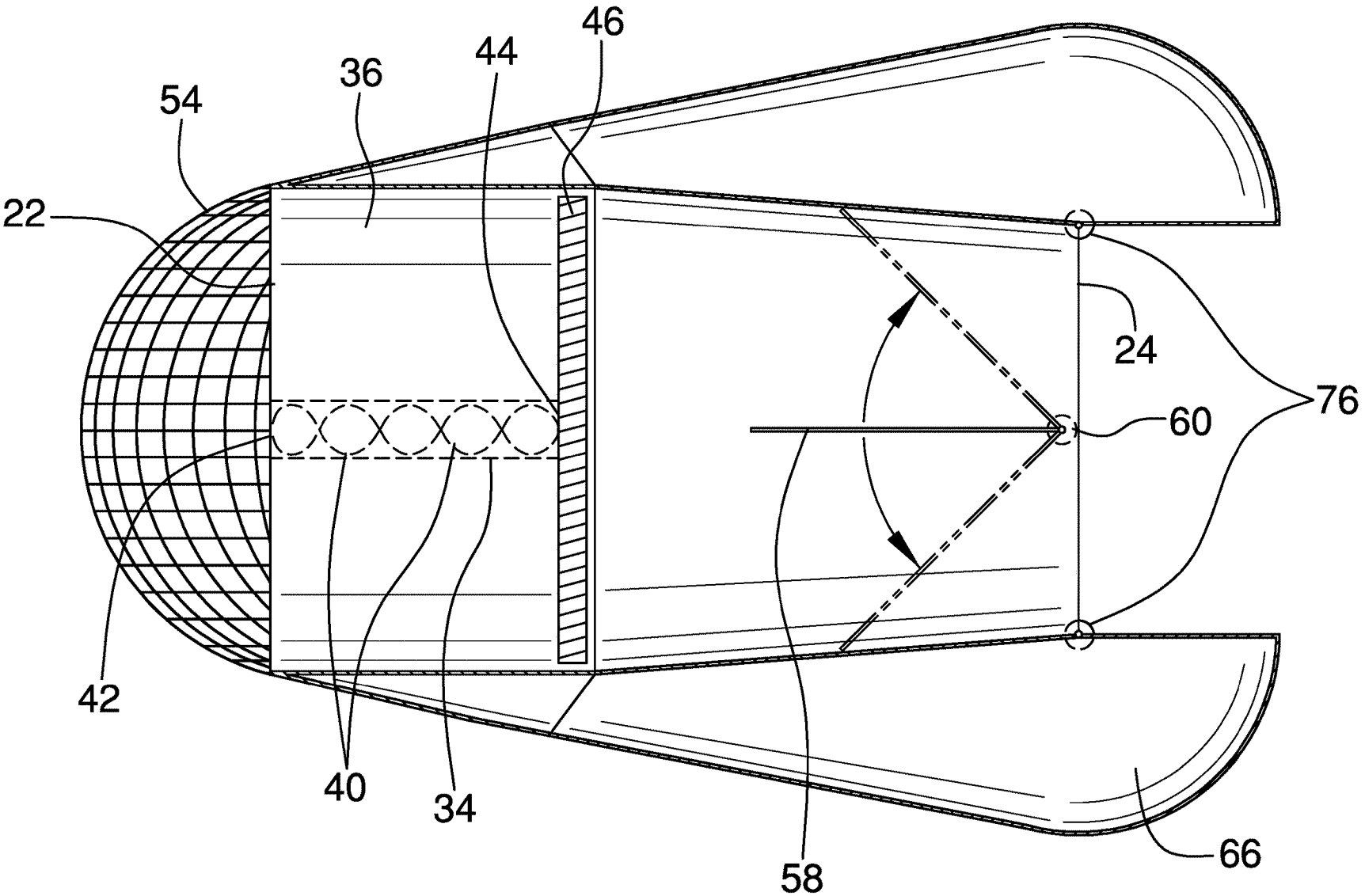
FIG. 3 is a top view of an embodiment of the disclosure.

The baffle actuator 60 is positioned to selectively urge the plate 58 from an open configuration to a closed configuration, as shown in FIG. 3. In the open configuration, the plate 58 is substantially perpendicular to the back end 20. In the closed configuration, the curved edge 64 of the plate 58 abuts the tube 12. A plurality of protrusions 80 is coupled to and extends from the curved edge 64 of the plate 58. The protrusions are positioned to separate the curved edge 64 from the tube 12 with the plate 58 in the closed configuration to allow some water to escape between the plate 58 and the tube 12.

Each of a pair of deflectors 66 is hingedly coupled to a respective opposing side 68 of the tube 12 and extends from proximate to the front end 18 past the back end 20 of the tube 12. The deflectors 66 are substantially semi-conically shaped.

Each deflector 66 comprises an apex section 70 that is fixedly coupled to the tube 12 proximate to the front end 18. A medial section 72 is hingedly coupled to the tube 12. The medial section 72 extends from the apex section 70 past the back end 20 of the tube 12. A base section 74 is fixedly coupled to and extends arcuately from the medial section 72 distal from the apex section 70.

Each of a pair of deflector actuators 76 is coupled to a respective opposing side 68 of the housing adjacent to the back end 20. The deflector actuators 76 are linear-type. Each deflector actuator 76 is operationally coupled to an associated deflector 66.

Figure 5:
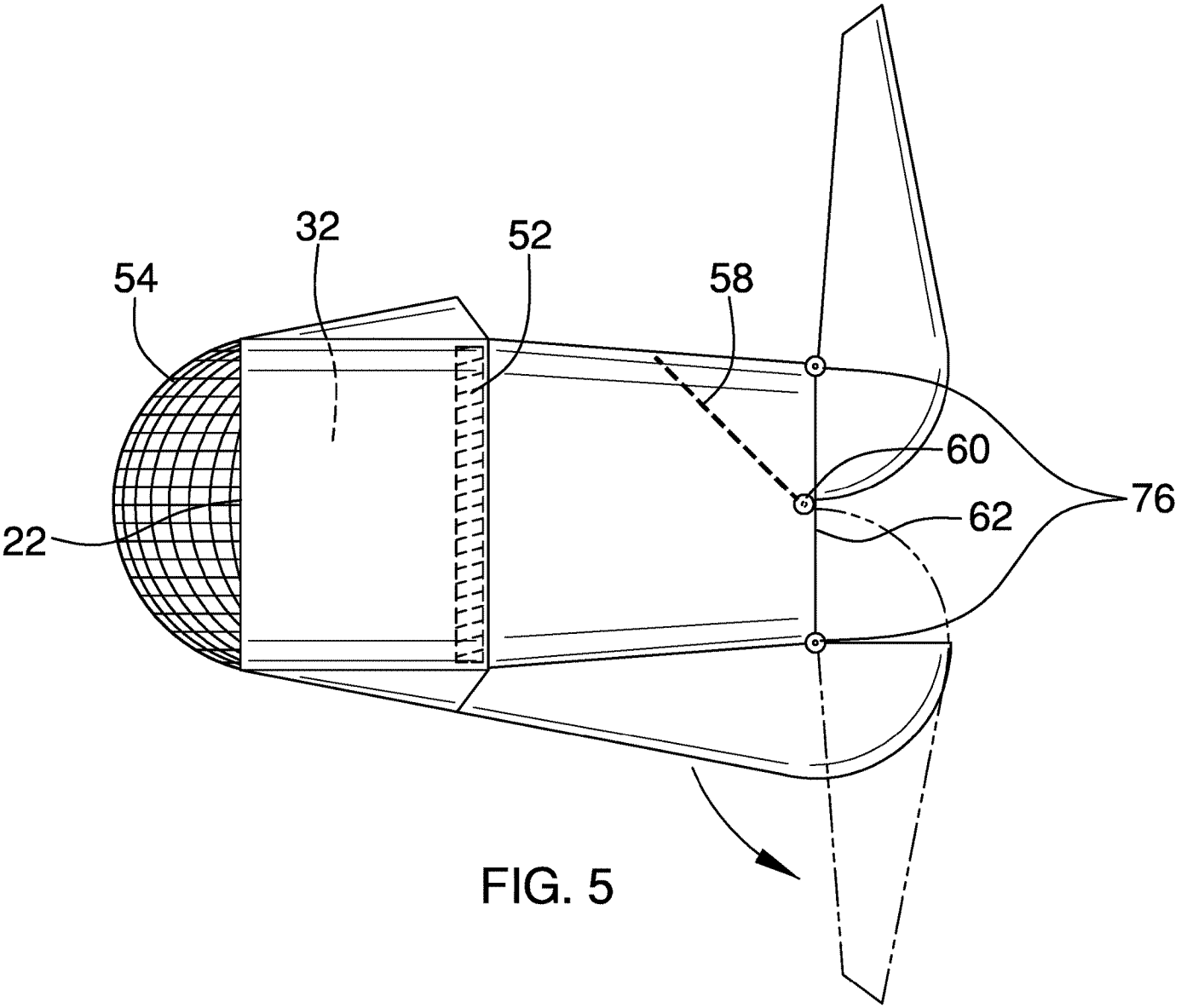
FIG. 5 is bottom view of an embodiment of the disclosure.

The deflector actuator 76 is positioned to selectively urge the associated deflector 66 from a stowed configuration to a deployed configuration. In the stowed configuration, the deflector 66 is positioned adjacent to the respective opposing side 68 of the tube 12, as shown in FIG. 3. In the deployed configuration, the deflector 66 is positioned perpendicularly to the tube 12 and is configured to adjust the speed and the direction of the marine vessel 16, as shown in FIG. 5. Selective positioning of the plate 58 and the deflectors 66 allows an operator to adjust the speed and the direction of the marine vessel 16. The apex section 70 serves to decrease friction of the deflector 66 when in stowed configuration.

In use, the impeller assembly 26 provides the thrust to propel the marine vessel 16 through a body of water. The grate 54 is configured to deter entry of the marine organism into the tube 12, thereby helping to prevent contact of the marine organism with the impeller assembly 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A watercraft propulsion device comprising:

a tube coupled to a hull of a marine vessel, the tube having a front end and a back end, the front end and the back end being open, the front end being circumferentially larger than the back end such that the tube is tapered;

an impeller assembly positioned in the tube, the impeller assembly being operationally coupled to a drive shaft of the marine vessel wherein a power plant of the marine vessel is positioned for rotating the impeller assembly concurrently with the drive shaft for increasing a pressure and a flow of water through the tube for generating thrust for propelling the marine vessel;

a grate coupled to a front perimeter of the tube such that the grate covers the front end wherein the grate is configured for deterring entry of a marine organism into the tube;

a pair of deflectors, each deflector being hingedly coupled to a respective opposing side of the tube and extending from proximate to the front end past the back end of the tube, the deflectors being substantially semi-conically shaped; and a pair of deflector actuators, the deflector actuators being linear-type, each deflector actuator being coupled to a respective opposing side of the tube adjacent to the back end, the deflector actuator being operationally coupled to an associated deflector wherein the deflector actuator is positioned for selectively urging the associated deflector from a stowed configuration wherein the deflector is positioned adjacent to the respective opposing side of the tube to a deployed configuration wherein the deflector is positioned perpendicularly to the tube wherein the deflector is configured for adjusting a speed and a direction of the marine vessel.

2. The device of claim 1, further including the tube having a back perimeter, the back perimeter measuring from sixty to ninety percent of the front perimeter.

3. The device of claim 2, further including the back perimeter measuring eighty percent of the front perimeter.

4. The device of claim 1, further including the impeller assembly comprising:

an impeller; and a drive gear coupled to the impeller, the drive gear being gearedly coupled to the drive shaft wherein the power plant of the marine vessel is positioned for rotating the impeller assembly concurrently with the drive shaft for increasing the pressure and the flow of the water through the tube for propelling the marine vessel.

5. The device of claim 4, further including the impeller comprising:

an inner ring;

an outer ring; and a plurality of vanes coupled to and extending between the inner ring and the outer ring.

6. The device of claim 5, further including the plurality of vanes comprising from eight to thirty-six vanes.

7. The device of claim 5, further including a plurality of blades coupled to and positioned within the inner ring, each blade extending spirally from a front edge to a back edge of the inner ring wherein the blades are configured for increasing the pressure and the flow of the water through the inner ring.

8. The device of claim 7, further including the plurality of blades comprising from three to nine blades.

9. The device of claim 5, further including the drive gear comprising a bevel gear coupled to an outer surface of the outer ring.

10. The device of claim 4, further including an opening positioned in a top of the tube, the drive shaft extending through the opening into the tube such that the drive shaft is gearedly coupled to the drive gear.

11. The device of claim 1, further including the grate being substantially hemispherically shaped.

12. The device of claim 1, further including a baffle coupled to and positioned in the tube proximate to the back end wherein the baffle is configured for selectively controlling the flow of the water through the back end of the tube for adjusting a speed and a direction of the marine vessel.

13. A watercraft propulsion device comprising:

a tube coupled to a hull of a marine vessel, the tube having a front end and a back end, the front end and the back end being open, the front end being circumferentially larger than the back end such that the tube is tapered;

an impeller assembly positioned in the tube, the impeller assembly being operationally coupled to a drive shaft of the marine vessel wherein a power plant of the marine vessel is positioned for rotating the impeller assembly concurrently with the drive shaft for increasing a pressure and a flow of water through the tube for generating thrust for propelling the marine vessel;

a grate coupled to a front perimeter of the tube such that the grate covers the front end wherein the grate is configured for deterring entry of a marine organism into the tube;

a baffle coupled to and positioned in the tube proximate to the back end wherein the baffle is configured for selectively controlling the flow of the water through the back end of the tube for adjusting a speed and a direction of the marine vessel;

a plate, the plate being semi-circularly shaped defining a straight edge and a curved edge of the plate, the plate being coupled to and extending between the back perimeter of the tube; and a baffle actuator coupled to the tube, the baffle actuator being linear-type, the baffle actuator being operationally coupled to the plate wherein the baffle actuator is positioned for selectively urging the plate from an open configuration wherein the plate is substantially perpendicular to the back end to a closed configuration wherein the curved edge of the plate abuts the tube.

14. The device of claim 13, further including a plurality of protrusions coupled to and extending from the curved edge of the plate wherein the protrusions are positioned for separating the curved edge from the tube with the plate in the closed configuration.

15. The device of claim 1, further including each deflector comprising:

an apex section fixedly coupled to the tube proximate to the front end;

a medial section hingedly coupled to the tube, the medial section extending from the apex section past the back end of the tube; and a base section fixedly coupled to and extending arcuately from the medial section distal from the apex section.

16. A watercraft propulsion device comprising:

a tube coupled to a hull of a marine vessel, the tube having a front end and a back end, the front end and the back end being open, the front end being circumferentially larger than the back end such that the tube is tapered, the tube having a front perimeter and a back perimeter, the back perimeter measuring from sixty to ninety percent of the front perimeter, the back perimeter measuring eighty percent of the front perimeter;

an impeller assembly positioned in the tube, the impeller assembly being operationally coupled to a drive shaft of the marine vessel wherein a power plant of the marine vessel is positioned for rotating the impeller assembly concurrently with the drive shaft for increasing a pressure and a flow of water through the tube for generating thrust for propelling the marine vessel, the impeller assembly comprising:

an impeller comprising:

an inner ring, an outer ring, a plurality of vanes coupled to and extending between the inner ring and the outer ring, the plurality of vanes comprising from eight to thirty-six vanes, and a plurality of blades coupled to and positioned within the inner ring, each blade extending spirally from a front edge to a back edge of the inner ring wherein the blades are configured for increasing the pressure and the flow of the water through the inner ring, the plurality of blades comprising from three to nine blades, and a drive gear coupled to the impeller, the drive gear being gearedly coupled to the drive shaft wherein the power plant of the marine vessel is positioned for rotating the impeller assembly concurrently with the drive shaft for increasing the pressure and the flow of the water through the tube for propelling the marine vessel, the drive gear comprising a bevel gear coupled to an outer surface of the outer ring;

an opening positioned in a top of the tube, the drive shaft extending through the opening into the tube such that the drive shaft is gearedly coupled to the drive gear;

a grate coupled to the front perimeter of the tube such that the grate covers the front end wherein the grate is configured for deterring entry of a marine organism into the tube, the grate being substantially hemispherically shaped;

a baffle coupled to and positioned in the tube proximate to the back end wherein the baffle is configured for selectively controlling the flow of the water through the back end of the tube for adjusting a speed and a direction of the marine vessel, the baffle comprising:

a plate, the plate being semi-circularly shaped defining a straight edge and a curved edge of the plate, the plate being coupled to and extending between the back perimeter of the tube a baffle actuator coupled to the tube, the baffle actuator being linear-type, the baffle actuator being operationally coupled to the plate wherein the baffle actuator is positioned for selectively urging the plate from an open configuration wherein the plate is substantially perpendicular to the back end to a closed configuration wherein the curved edge of the plate abuts the tube, and a plurality of protrusions coupled to and extending from the curved edge of the plate wherein the protrusions are positioned for separating the curved edge from the tube with the plate in the closed configuration;

a pair of deflectors, each deflector being hingedly coupled to a respective opposing side of the tube and extending from proximate to the front end past the back end of the tube, the deflectors being substantially semi-conically shaped, each deflector comprising:

an apex section fixedly coupled to the tube proximate to the front end, a medial section hingedly coupled to the tube, the medial section extending from the apex section past the back end of the tube, and a base section fixedly coupled to and extending arcuately from the medial section distal from the apex section; and a pair of deflector actuators, the deflector actuators being linear-type, each deflector actuator being coupled to a respective opposing side of the tube adjacent to the back end, the deflector actuator being operationally coupled to an associated deflector wherein the deflector actuator is positioned for selectively urging the associated deflector from a stowed configuration wherein the deflector is positioned adjacent to the respective opposing side of the tube to a deployed configuration wherein the deflector is positioned perpendicularly to the tube wherein the deflector is configured for adjusting the speed and the direction of the marine vessel.

* * * * *